United States Patent [19]

Hill et al.

[11] Patent Number: 4,610,015

[45] Date of Patent: Sep. 2, 1986

[54] ELECTRODE ASSEMBLY FOR ARC FURNACES

[75] Inventors: Derek Hill, Hatfield, United Kingdom; Inge Lauterbach-Dammler, Nuremberg, Fed. Rep. of Germany; Tom Taube, Erlangen, Fed. Rep. of Germany; Dieter Zollner, Schwaig, Fed. Rep. of Germany

[73] Assignee: Arc Technologies Systems Ltd., Cayman Islands

[21] Appl. No.: 640,036

[22] Filed: Aug. 10, 1984

[30] Foreign Application Priority Data

Aug. 13, 1983 [CH] Switzerland ..... 4411/83

[51] Int. Cl.[4] ..... H05B 7/08; H05B 7/12

[52] U.S. Cl. ..... 373/93

[58] Field of Search ..... 373/93, 91, 92

[56] References Cited

U.S. PATENT DOCUMENTS 2,960,557 11/1960 Beecher et al. ..... 373/93

3,392,227 7/1968 Ostberg ..... 373/93

*Primary Examiner*—Roy N. Envall, Jr.

*Attorney, Agent, or Firm*—John J. Freer

[57] ABSTRACT

An arc electrode assembly comprises a water-cooled metal shaft and a consumable active portion, being interconnected by means of a screw nipple. The metal shaft is surrounded below its clamping area by a protective jacket being detachably arranged about the metal shaft. Between the jacket and the metal shaft a layer of electrically insulating refractory material is arranged which is cooled by the cooling system of the jacket. The protective jacket comprises at least one steel tube which is provided for the passage of a cooling medium. The steel pipe(s) may additionally be surrounded by refractory or slag material or may directly be embedded into such material.

13 Claims, 4 Drawing Figures

ELECTRODE ASSEMBLY FOR ARC FURNACES

FIELD OF THE INVENTION

The invention relates to an electrode assembly for arc furnaces, having a metal shaft comprising a water cooling system and a clamping area, the metal shaft being surrounded by a protective jacket which is arranged below the clamping area, the assembly further including a consumable active portion, said metal shaft and said active portion being electrically interconnected by connecting means.

BACKGROUND OF THE INVENTION

From the European Patent Application No. 50682 (U.S. Pat. No. 4,468,783) an electrode for arc furnaces is known, showing the above-mentioned characteristics. The electrode described in this patent application consists of a metal shaft connected to the active portion by means of a nipple, and has a protective jacket enveloping the metal shaft.

A combination electrode is disclosed in the U.S. Pat. No. 4,121,042, the water-cooled metal shaft of which being directly exposed, i.e. without any protective jacket, to the atmosphere of the furnace and to the attack of the arc. The electrode has to be clamped directly on the metal shaft.

The UK Patent Application No. 2,037,549 shows a combination electrode having a metal shaft which consists of two water pipes surrounded by a jacket of steel produced from three coaxial cylinders, thus forming two annular spaces forming part of a water cooling circuit. The described jacket surrounds the inner pipes substantially over their entire length, and the electrode is clamped by this jacket.

The electrode according to the European Application No. 50682 has very good operating characteristics and is already in use in a number of arc furnaces. Since the principal motive promoting today the development of water-cooled electrodes is to reduce the cost of steel production, new possibilities are desired to save additional cost. For this reason, further efforts have been made in order to reduce the maintenance cost of the electrode known from the European Application No. 50682, without any risk for the good operating characteristics.

The electrode according to U.S. Pat. No. 4,121,042 has the drawback that its metal part consists of a single integral element so that, with the peripheral metal wall damaged by an arc or by a mechanic impact of heavy scrap pieces, the whole electrode has to be disassembled and reassembled after exchange of the damaged parts.

The electrode described in British Patent No. 2,037,549 has a steel jacket also connected to the inner cooling pipes of the electrode, and therefore cannot be exchanged.

Furthermore, it is disadvantageous that clamping of the electrode is effected by its jacket, since the latter has to be for this purpose of an enormous mechanical resistance in order to absorb the clamping forces being in the order of 20 to 40 tons.

The U.S. Pat. No. 4,291,190 discloses an electrode holder according to the one mentioned in the preamble which comprises several vertically assembled water pipes for cooling a nipple at the lower end of the electrode holder. The water pipes are embedded within a cylinder of refractory material which in turn is encompassed by a hollow cylinder of steel which snugly fits to the refractory cylinder. It is claimed in this patent, that the metal cylinder is electrically insulated from the current conducting water pipes by the refractory cylinder. However, the same refractory cylinder is supposed to sufficiently cool the metal cylinder by heat conduction to the water pipes.

It is well known, that good heat conductors are good electrical conductors too and vice versa. The above electrode has therefore the disadvantage, if the metal cylinder should be sufficiently cooled, that the electrical insulation of the metal cylinder from the water pipes is not perfect, an effect which becomes still stronger with higher temperatures. It is, however of great importance to keep the metal sheath electrically insulated from all parts which are kept on electrode potential, since a non-insulated metal sheath would be exposed to the formation of electric arcs between the sheath and scrap which comes close to it, and would therefore quickly be damaged.

SUMMARY OF THE INVENTION

It is an object of the present invention to improve the electrode assembly described, and to reduce its maintenance cost as well as to avoid the above-mentioned disadvantages.

It is another object of the invention to provide an electrode holder for arc furnaces, the metal sheath of which is effectively insulated from other electrode parts which are kept on electrode potential.

It is a further object of the invention to provide a protective sheath around the electrode holder, which has a long life time, but which is also simple to remove in case of wear.

These objects are attained according to the invention with an electrode assembly as further herein generally described whereby the protective jacket comprises a cooling system, a refractory layer being arranged between the cooled protective jacket and the metal shaft, thereby electrically insulating them from each other, the refractory layer being cooled by the cooling system of the protective jacket, said jacket being detachably arranged on said metal shaft.

The present invention is based on the discovery that protective metal jackets which are directly exposed to the arc furnace interior are gradually loosing their electrical insulation as they are heated up, due to the increase of electrical conductivity of the refractory material which separates them from the current conducting components. It is therefore proposed, to provide a water cooling equipment which cools the metal jacket (as it is known in the prior art), but which also keeps the temperature of the insulating refractory material sufficiently low to ensure its good insulating characteristics.

The materials for the metal shaft and the protective jacket may be freely selected in accordance with their properties and purposes. The metal shaft has primarily the purpose to conduct the electric current to the active portion with the smallest possible losses, and further to ensure a good cooling effect for the active portion. Both are aspects which recommend the use of copper.

The metal jacket, however, should have a high melting point together with a good mechanical stability. Moreover, the jacket should be acceptable in costs since it is a wear part, and may have to be exchanged. For this purpose, an optimal material offering the necessary technical properties at an acceptable price, is steel.

BRIEF DESCRIPTION OF THE DRAWINGS

The invention will be described in detail in connection with embodiments shown in the drawings.

Shows an electrode according to the invention, having cooling water circulation means within the protective jacket, which is connected in series to the cooling circuit of the metal shaft.

FIG. 2

Figure 1:
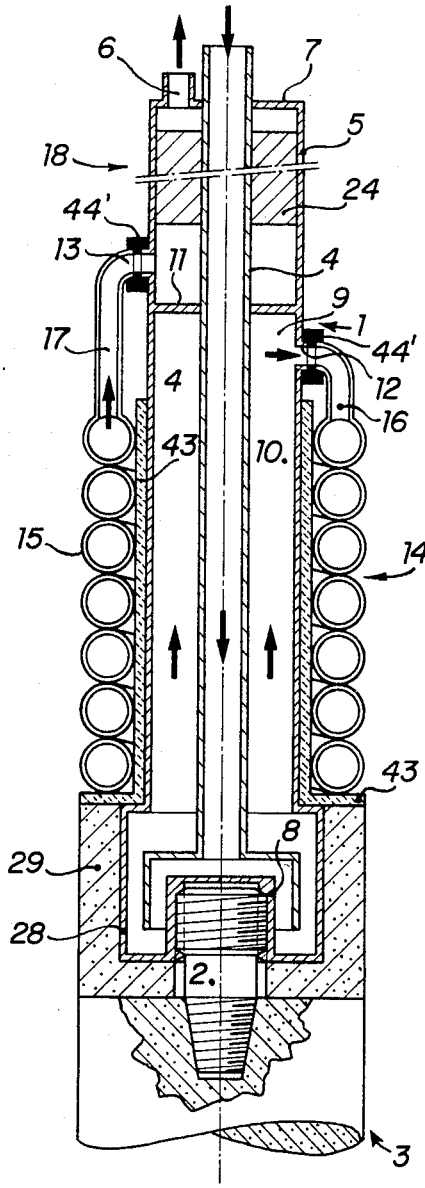
FIG. 1

Illustrates an electrode assembly similar to that of FIG. 1 and having a protective jacket, the cooling system of which is independent from that of the metal shaft.

FIG. 3

Shows a further embodiment of the invention, whereby a cooling coil is embedded in a refractory cylinder which in turn is surrounded by several rings in its lower region.

FIG. 4

Shows an embodiment of the invention which comprises a protective jacket formed of two concentric cylinders with internal water circuit means.

DESCRIPTION OF PREFERRED EMBODIMENTS

According to one embodiment of the invention, the cooling system of the protective jacket may be connected in series to the cooling system of the metal shaft, wherein different possibilities may be taken into consideration. For example the cooling medium could first flow through the protective jacket and then through the metal shaft or vice-versa, or the metal shaft could comprise a plurality of sections, the protective jacket being arranged between two sections of the metal shaft in relation to the flow of cooling medium.

In accordance with a preferred embodiment of the invention, the protective jacket may be formed by a helically closely coiled system of metal tubes. This kind of a protective jacket allows a particular simple manufacture and is also easy to repair, in case it is damaged in the course of operation.

In an embodiment of the electrode assembly where the protective jacket is arranged between two sections of the metal shaft in relation to the flow of cooling medium, the metal shaft may comprise a central pipe and an external pipe surrounding said central pipe, an annular space being formed between both pipes. The annular space may be divided into an upper and a lower annular space section at a level substantially corresponding to the height of the protective jacket by means of a plate connected to said two pipes. These annular space sections may then comprise respective connection sockets through which they can be connected to the interior of the jacket.

The protective jacket is arranged around the metal shaft in an electrically insulated manner, whereby the junction of the connection sockets may be effected through electrically insulated intermediate pieces, and the electrically insulating intermediate layer may be a ceramic mat, sprayed ceramic or the like.

In a particular embodiment of the invention, the cooling medium used for the metal shaft is different from that of the protective jacket. For example, the metal shaft may be cooled with water, whereas the protective jacket may be cooled by a gas, e.g. by water steam. This has the advantage that in the case of possible damage of the protective jacket no water can enter into the arc furnace. To this end, the protective jacket comprises supply and discharge conduits being independent from the metal shaft.

In order to improve the protection characteristics of the protective jacket, the same may comprise an outer layer of sprayed or laminated refractory mass, ceramics and/or slag at least in its lower range.

Referring now to FIG. 1, a metal shaft 1 of a combined arc furnace electrode is illustrated which is connected to an active portion 3 of graphite (only the coupling portion of which is shown) by a screw nipple 2. The metal shaft 1 consists of a central pipe 4 and an external pipe 5 arranged coaxially about the pipe 4. An annular space is formed between the pipes 4 and 5 which is closed at its top by an annular disk 7, with exception of an outlet socket 6. At its lower end 28, the metal shaft 1 is enlarged and provided with a bore being accessible from below and having an internal thread 8 into which the nipple 2 is screwed. The lower end 28 of the metal shaft also has an external thread (not shown) onto which a ring 29 of a material containing graphite is screwed, said ring 29 being L-shaped in profile.

Alternatively, the connection of the metal shaft 1 with the active portion 3 can be effected by clamping means, e.g., as described in the European Patent Application No. 0053200, instead of a nipple.

The central and the external pipes 4, 5, in particular the annular space between them serves for the supply and the discharge of a cooling medium, for example water, which enters through the central pipe according to the arrows shown, is deviated at the lower end of the metal shaft, rises then through the annular space and leaves the metal shaft through the outlet socket.

The annular space formed by the central pipe 4 and the external pipes is divided into an upper annular space 9 and a lower annular space 10 by an annular disk 11 welded to the two pipes.

The lower annular space 10 comprises a lateral outlet socket 12 near its upper end surface formed by the underside of the annular disk 11, the upper annular space 9 including an inlet socket 13 near its bottom surface.

A protective jacket 14 consisting of a system of metal tubes 15 extending helically about the external pipe 5, is arranged about that range of the metal shaft 1 which corresponds substantially to the lower annular space 10.

The system of metal tubes 15 may consist of a single metal tube coiled in bifilar manner, the beginning and the end of the metal tube being arranged at the top of the helical coil, or it is built up from a plurality of parallel loops.

Beginning and end of the metal tube 15 have connection branches 16 and 17 joint to the outlet and inlet sockets 12 and 13 of the annular spaces 9 and 10, as schematically illustrated.

Thus, cooling water flows, after the deviation in the lowermost range of the metal shaft, through the lower annular space 10 upwards to the annular disk 11, leaves the annular space throughout the outlet socket 12 and reaches the protective jacket 14 through which it flows according to the arrows in the tubes from the top to below and again upwards where the cooling water leaves the jacket through the connection branch 17 enters the upper annular space 9 throught the inlet socket 13 and leaves this space by the outlet socket 6.

The protective jacket 14 is connected with the metal shaft 1 only by the water connections consisting of the inlet and outlet sockets 12 and 13 and the connection branches 16 and 17, thus being separable in a simple manner by disconnecting the water connections. The entire protective jacket may then be completely removed (for repair or exchange) by drawing it axially from the metal shaft 1.

The water-cooled protective jacket has two functions, one being the shielding of the metal shaft of copper from the interior of an arc furnace, and particularly from the direct setting of an arc onto copper parts, the other is the cooling of an intermediary refractory mass 43 in order to keep its temperature below the point where it loses its electrically insulating properties.

It is very important that the jacket stays electrically insulated from the metal shaft to avoid the formation of arcs which strike from scrap to the jacket.

In order to improve the protection characteristics, the protective jacket 14 may additionally be protected on its periphery by refractory material, ceramics and/or slag.

The aforementioned refractory mass 43 is arranged in between the metal shaft and the jacket 14, and also below the jacket at the region where the shaft abuts unto the nipple area, in order to keep it insulated therefrom too. The water connections between the jacket and the metal shaft comprise electrically insulating intermediate pieces 44 and 44' which complete the electrical insulation between the metal shaft and the jacket. The refractory mass may further be extended around the lower ends of the jacket in order to ensure a safe insulation at that point in the event of slag splashes which may bridge the insulating gap with electrically conducting slag.

By these measures, the potential of the protective jacket 14 is uncoupled from the metal shaft 1 so that it may be held on ground potential. In this way, the development of lateral arcs between pieces of scrap lying also on ground potential in the furnace and the jacket is impeded.

The uppermost range of the metal shaft 1 which is not enveloped by the protective jacket 14 serves to apply the electrode holder by which also the electric connection will be effected.

Within the range of a clamping area or zone 18 of the metal shaft 1, reinforcing ribs 24 extending in paraxial (as shown) or radial direction are provided between the external pipe 5 and the central pipe 4.

These reinforcing ribs 24 have the purpose to prevent a deformation of the external pipe 5 when the clamping jaws (not shown) are pressed against it.

Figure 2:
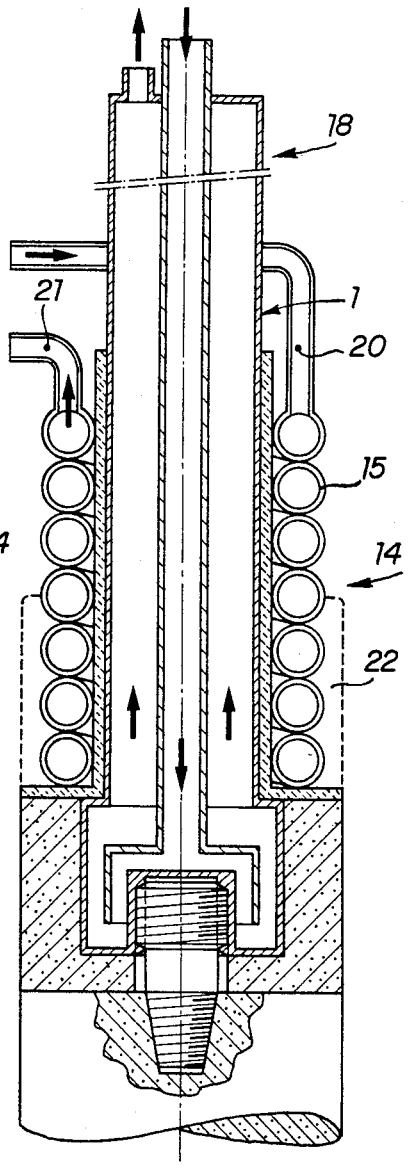

FIG. 2 shows an arc electrode assembly similar to the embodiment depicted in FIG. 1, in which, however, the protective jacket 14 has a cooling circuit which is independent from the cooling system of the metal shaft.

All parts being unnecessary for the explanation of this difference are not mentioned in the following, as far as they have already been described in connection with FIG. 1.

The protective jacket 14, generally being formed as in FIG. 1, has connection branches 20 and 21 at the beginning and the end of the metal tube 15, through which the cooling medium may respectively be supplied and discharged.

These branches or conduits 20 and 21 for the cooling medium extend in such a manner that they cannot interfere with the clamping of the electrode, i.e., they are leading away from the metal shaft 1 below the clamping area 18 of the same. Also in this case, the protective jacket 14 is electrically insulated from the metal shaft by a refractory layer 43.

On account of the independence of the supply of cooling medium to the protective jacket and to the metal shaft, there exists the possibility to cool the protective jacket by a cooling medium which is different from that of the metal shaft.

For example, the protective jacket may be cooled by water steam or another gas so that in case of a possible leakage of the protective jacket, a gas will reach the furnace chamber or the melt, and not a liquid. This is much less problematic and prevents any possibility of a water explosion in the furnace.

Figure 3:
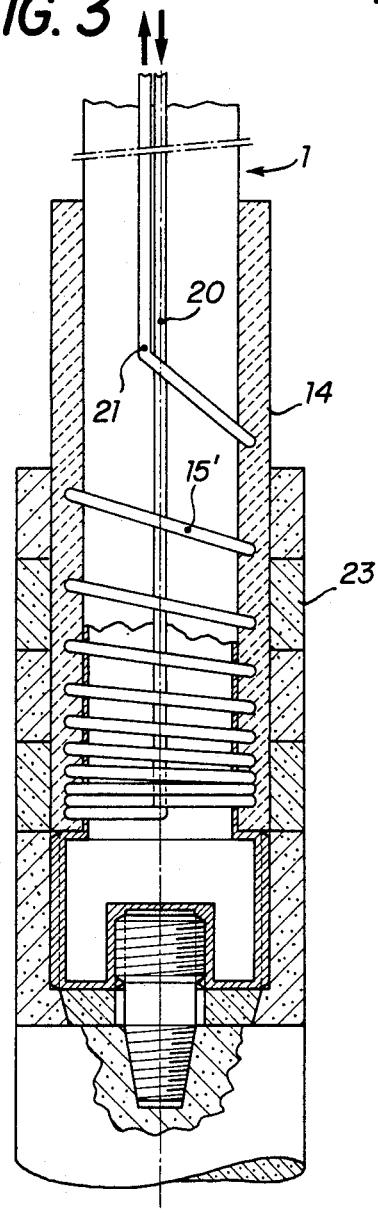

In FIG. 3 another embodiment of the invention is shown in which the protective jacket 14 consists of a coil formed by a metal tube 15' which is embedded within a cylinder of a refractory mass surrounding the metal shaft 1.

In this case, the arrangement is such tnat the metal tube 15' is completely surrounded by the refractory mass, being thus electrically insulated from the metal shaft 1.

The metal tube 15' is provided with connection branches 20 and 21 enabling a supply of cooling medium to the protective jacket which is independent from the cooling system of the shaft.

The protective jacket 14 may either be directly exposed to the atmosphere of the furnace and to possible slag spatters, or be additionally protected by rings 23 consisting of graphite or a graphite containing material.

Figure 4:
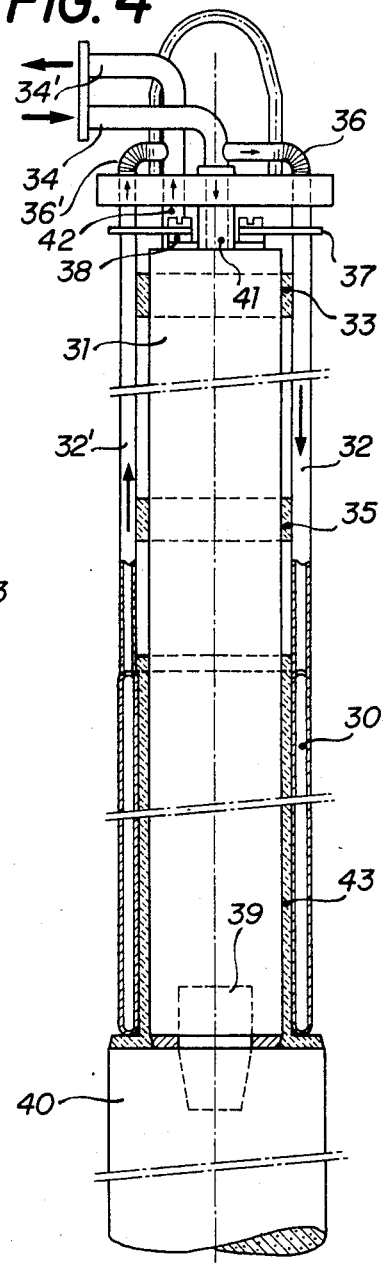

In FIG. 4 a further embodiment of the invention is shown, in which the metal shaft 31 corresponds to those of the FIGS. 2 and 3. The metal shaft 31 of an electrode holder is connected to the active portion 40 by a screw nipple 39. On the top of the metal shaft 31, an inlet socket 41 and an outlet socket 42 for the cooling water are connected to water supply pipes 34 and 34'. These supply pipes are also connected to flexible water hoses 36 and 36' by which cooling water ducts 32 and 32' are communicatingly connected to the supply pipes. The ducts 32 and 32' lead to a jacket 30, which surrounds the lower region of the metal shaft. By means of a cylindrical refractory layer 43 which is arranged between the metal shaft and the jacket 30 and two other similar rings 33 and 35 of smaller axial dimension than the layer 43, the jacket 30 with respect to the ducts 32 and 32' are electrically insulated from the metal shaft 31. The mechanical fixation of the ducts 32 and 32' is effected by holder bars 37, which are fastened to the metal shaft 31 by means of bolts or the like via insulating pads 38 thus completing the electrical insulation from the metal shaft 31. At the lower end of the jacket 30 the refractory material 43 is extended between the active portion and the jacket 30, and may advantageously be continued at the outside of the jacket 30 to cover at least the lower region thereof. Thus, slag splashes which may bridge the active portion with the jacket 30 can not create an electrical connection between them.

In the foregoing, the invention has been explained on the basis of the embodiments only by way of example, but is by no means restricted to them. For example, the shape of the protective jacket as a helical tube system is merely an embodiment being advantageous to manufacture, but a number of other shapes of water circuits can be imagined, e.g., two or three coaxial tubes forming external and internal annular spaces, whereby the cooling water can flow in one annular space downwards and in an other annular space upwards, or two coaxial cylinders having baffles between them which force the cooling medium to a meander-like circuit.

Alternatively, paraxially extending tubes may be provided which are communicatingly interconnected in pairs at their lower ends, the water circuit through these pairs of tubes being connected in series or in parallel.

Equally, the invention is not limited to the choice of materials, as copper or steel, which are only examples, but a multitude of metallic materials may be used under economic and technical considerations, without departing from the scope of the claims.

1. In an electrode assembly for arc furnaces, having a metal shaft comprising a water cooling system and a clamping area, the metal shaft being surrounded by a protective jacket which is arranged below the clamping area, the assembly further including a consumable active portion, said metal shaft and said active portion being electrically interconnected by connecting means, the improvement comprising a refractory, electrically insulating ceramic layer susceptible to loss of insulation characteristic at elevated temperature, and having a main insulation section for said metal shaft plus a lower insulation component in contact with a lower graphite material or consumable active portion, a cooled protective jacket detachably arranged on said metal shaft and in resting engagement on said lower insulation component, said jeacket being thereby in cooling contact with both said insulating ceramic layer main section plus said lower insulation component, thereby electrically insulating said metal shaft and lower graphite material or consumable active portion from the protective jacket, the refractory layer being cooled by the cooling system of the protective jacket, whereby said main insulation section and lower component maintain insulation characteristic at elevated temperature.

2. The electrode assembly of claim 1, characterized in that the metal shaft consists of copper, and the protective jacket of steel and cooling medium is used to cool said metal shaft which medium is different from cooling medium of said protective jacket.

3. The electrode assembly of claim 1, characterized in that the cooling system of the metal shaft is connected in series to the cooling system of the protective jacket.

4. The electrode assembly of claim 1, characterized in that the protective jacket is formed by a coiled tube.

5. The electrode assembly of claim 1, characterized in that the protective jacket comprises concentric metal cylinders arranged around the metal shaft comprising baffles between cylinders to force the cooling medium circuit through a meander-like path within the cylinders.

6. The electrode assembly of claim 1, characterized in that the protective jacket comprises concentric cylinders defining concentric annular spaces between them, within one of which the cooling medium flows downwards and in at least one other of which the cooling medium flows back upwards.

7. The electrode assembly of claim 1, characterized in that the metal shaft comprises a central pipe and an external pipe surrounding said central pipe, an annular space being formed between said two pipes; the annular space being subdivided into an upper and a lower annular space section by supporting means connected to said two pipes at a level substantially corresponding to the height of the protective jacket, the upper and the lower annular space sections being connectable by connection means to the cooling system of the protective jacket.

8. The electrode assembly of claim 1, characterized in that the protective jacket is insulated from the metal shaft by electrical insulation means, and the cooling system of said protective jacket is connected to the metal shaft electrical insulation connection means.

9. The electrode assembly of claim 1, characterized in that the cooling system of the protective jacket comprises cooling medium supply and discharge means which are independent from the cooling system of the metal shaft.

10. The electrode assembly of claim 1, characterized in that the protective jacket comprises an outer covering layer.

11. The electrode assembly of claim 10, characterized in that the outer covering layer comprises sprayed or laminated refractory material, ceramic or slag, said layer covering at least a lower portion of the jacket.

12. The electrode assembly of claim 10, characterized in that the protective jacket is surrounded by rings containing graphite.

13. The electrode assembly of claim 1, characterized in that the clamping area comprises a central pipe and an external pipe, and paraxially extending reinforcement ribs are arranged within said pipes.

* * * * *